US007080633B2

(12) United States Patent
Wenger et al.

(10) Patent No.: US 7,080,633 B2
(45) Date of Patent: Jul. 25, 2006

(54) GAS-DYNAMIC PRESSURE WAVE MACHINE

(75) Inventors: Urs Wenger, Langenthal (CH); Roger Martin, Othmarsingen (CH)

(73) Assignee: Swissauto Engineering S.A. (CH)

( * ) Notice: Subject to any disclaimer, the term of this patent is extended or adjusted under 35 U.S.C. 154(b) by 459 days.

(21) Appl. No.: 10/384,898

(22) Filed: Mar. 7, 2003

(65) Prior Publication Data

US 2003/0226353 A1 Dec. 11, 2003

(30) Foreign Application Priority Data

Mar. 18, 2002 (EP) ..... 02006066

(51) Int. Cl.
*F02B 33/42* (2006.01)
*F02B 33/00* (2006.01)
*F02D 35/00* (2006.01)

(52) U.S. Cl. ..... 123/559.2

(58) Field of Classification Search ..... 123/559.2; F02D 35/00; F02B 33/42, 33/00
See application file for complete search history.

(56) References Cited

U.S. PATENT DOCUMENTS

| | | | | |
|---|---|---|---|---|
| 4,488,532 A | | 12/1984 | Mayer | 123/559.2 |
| 4,561,407 A | * | 12/1985 | Jaussi et al. | 123/559.2 |
| 4,662,342 A | * | 5/1987 | Altmann et al. | 123/559.2 |
| 4,723,525 A | * | 2/1988 | Fried et al. | 123/559.2 |
| 4,796,595 A | * | 1/1989 | El-Nashar et al. | 123/559.2 |
| 6,367,460 B1 | * | 4/2002 | Wenger et al. | 123/559.2 |
| 6,543,228 B1 | * | 4/2003 | Deacon | 60/602 |

FOREIGN PATENT DOCUMENTS

| | | | |
|---|---|---|---|
| CH | 681738 | 5/1993 | |
| EP | 0 210 328 | 3/1986 | 123/559.2 |
| EP | 0 885 352 | 12/1999 | 123/559.2 |
| WO | 99/11914 | 3/1999 | 123/559.2 |

OTHER PUBLICATIONS

Search Report for EP 02 00 6066.

* cited by examiner

*Primary Examiner*—Thai-Ba Trieu
(74) *Attorney, Agent, or Firm*—Ostrolenk, Faber, Gerb & Soffen, LLP

(57) ABSTRACT

A gas-dynamic pressure wave supercharger includes a multi-cell rotor, a fresh air inlet channel, a high pressure air channel leading to the engine, and high and low pressure exhaust channels, with the high and low pressure exhaust channels enclosed in a gas enclosure, and the fresh air inlet channel and the high pressure charge air channel enclosed in an air enclosure. The high pressure exhaust channel includes an enlarged portion on the rotor side from which a duct extends to the low pressure channel. The duct is so regulated that a part of the exhaust gas is always first conducted from the high pressure exhaust channel into the enlarged portion before additional exhaust gas is conducted through the duct from the high pressure exhaust channel to the low pressure exhaust channel. Improved fuel consumption results over the entire performance range of the engine, particularly in the partial load range.

10 Claims, 3 Drawing Sheets

FIG. 1 --Prior Art--
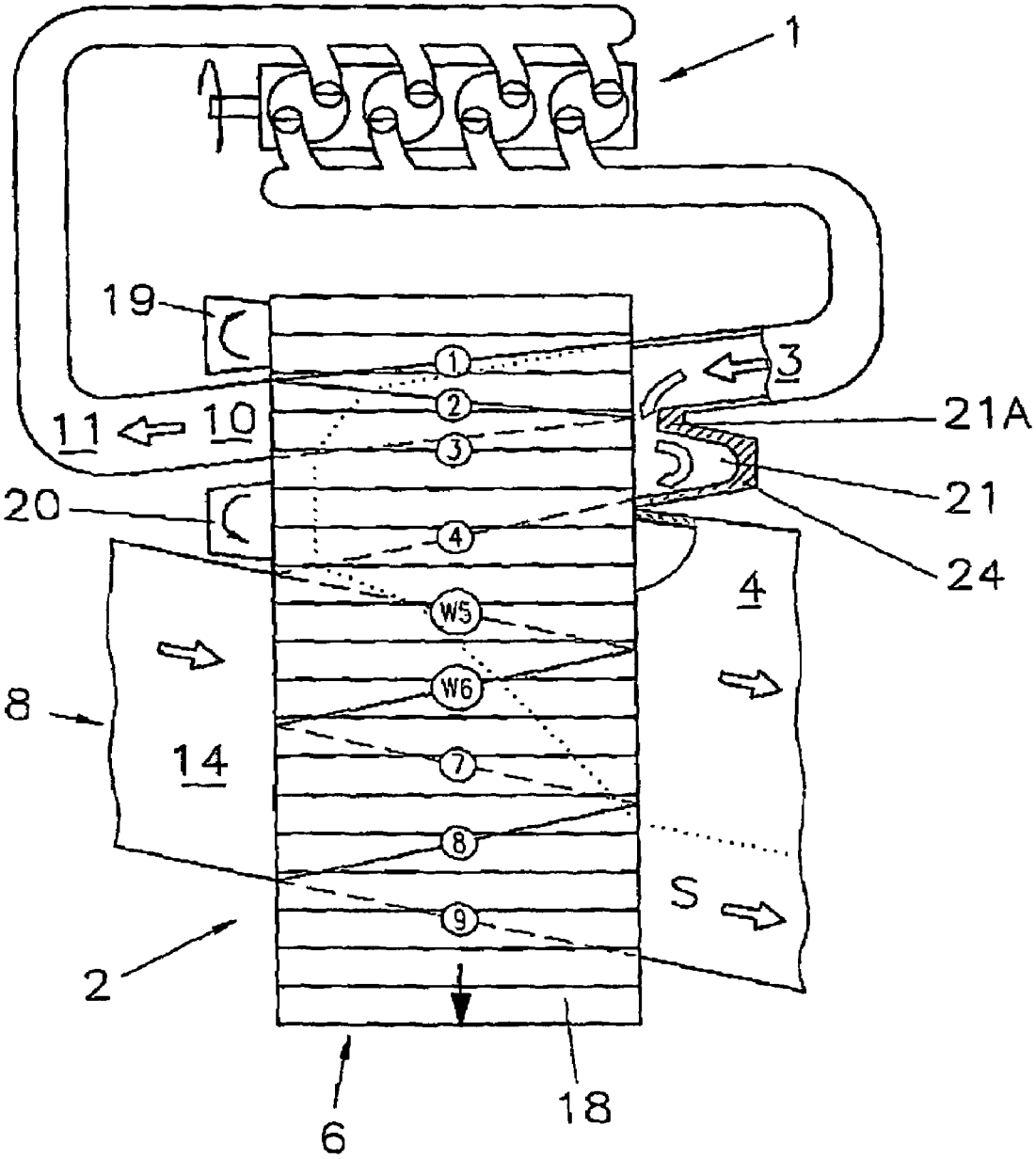

--Prior Art-- FIG. 2
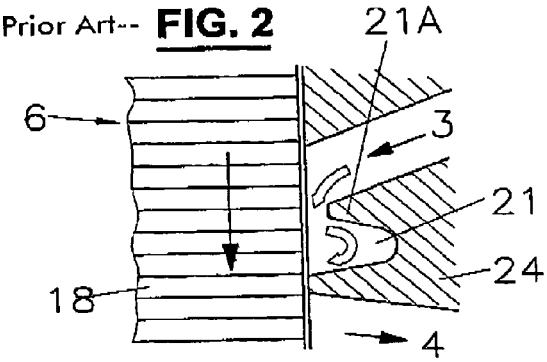
FIG. 3
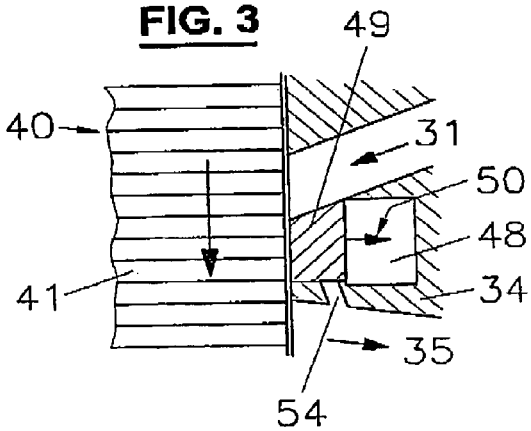
FIG. 3A
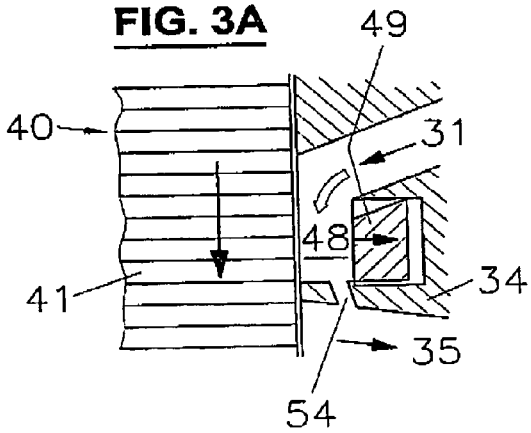
FIG. 4
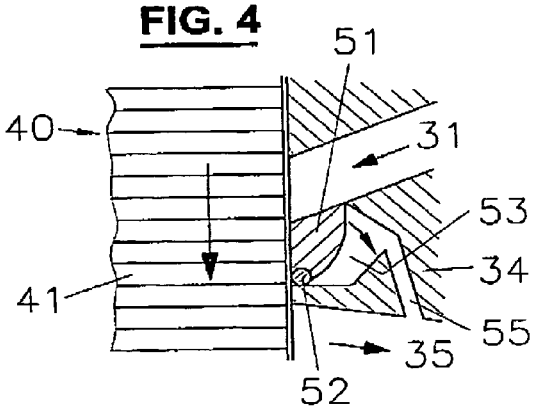
FIG. 4A
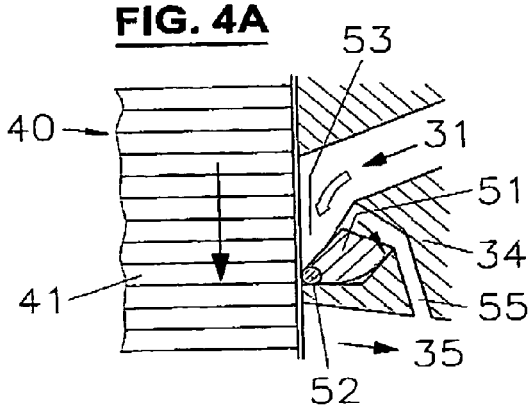

GAS-DYNAMIC PRESSURE WAVE MACHINE

BACKGROUND OF THE INVENTION

The present invention refers to a gas-dynamic pressure wave machine intended for supplying charge air to an internal combustion engine, comprising a rotor with cells, a low pressure fresh air inlet channel, a high pressure charge air channel leading to the internal combustion engine, a high pressure exhaust channel coming from the internal combustion engine, and a low pressure exhaust channel, the high pressure exhaust channel and the low pressure exhaust channel being enclosed in a gas enclosure and the low pressure fresh air inlet channel and the high pressure charge air channel being enclosed in an air enclosure, and the high pressure exhaust gas channel being provided on the rotor side with an enlargement.

A pressure wave machine of this kind is described in detail in WO 99/11914 to the applicant of the present invention, to which it is referred.

In a gas-dynamic pressure wave machine for supercharging internal combustion engines, operated with four channels and without additional control devices in the form of pockets, the process is only adjusted for a single operating point of the internal combustion engine. This is called the design point of the pressure wave machine. The use of so-called pockets in the enclosure walls allows a less tuning-sensitive design of the pressure wave machine and a significant extension of its load, speed, and volume range. The disadvantage of this method is an increase of the losses caused by secondary processes in the pockets, such as the inflow and outflow of the gases and the creation of pressure and expansion waves by the pockets.

The transition from the so-called primary process to the principal process, i.e. the tuned process, causes disturbances in the pressure wave process that lead to scavenging disruptions and thus to ranges of increased recirculation of exhaust gas into the charge air. In order to prevent an increased recirculation in these ranges as well as during starting, an inlet to the gas pocket, either in the form of a milled sill or of a controlled inlet must be provided, e.g. according to CH-A-681 738.

EP-B-885 352, for example, discloses a method allowing, in a standard pressure wave machine provided with a so-called wastegate flap, to divert excess high pressure exhaust gas, e.g. in the partial load range of the internal combustion engine, from the high pressure exhaust gas channel to the low pressure exhaust gas channel and thus to reduce the pressure upstream of the pressure wave machine. This will also reduce the pressure downstream of the pressure wave machine and thus the pressure in the intake channel of the internal combustion engine. However, in the absence of an inlet to the gas pocket, the opening of the wastegate will not only lead to the blowoff of the excess high pressure exhaust gas but also to a collapse of the scavenging of the rotor of the pressure wave machine. In the worst case, this may even cause a recirculation of the exhaust gas into the intake channel of the internal combustion engine, and in any event a significant deterioration of the compression efficiency of the pressure wave machine.

For example the previously mentioned applications CH-A-681 738 and EP-A-0 210 328 disclose a method according to which the exhaust gas expelled by the internal combustion engine allows to blow off the excess high pressure gas into the gas pockets through a bypass leading to the gas pocket of the pressure wave machine, thereby providing an improvement of the compression efficiency due to an improved scavenging of the rotor.

WO 99/11914 mentioned in the introduction in turn avoids the permanent use of a gas pocket and the resulting losses and eliminates the ridge between the exhaust gas channel and the gas pocket, which disturbs the pressure wave process when the inlet is open, as well as the energy losses in the form of flow and temperature losses caused by the geometry of the inlets to the gas pocket and the limitations in the design of the other channels.

However, the disadvantage of all these methods is that in the partial load range of the internal combustion engine, by blowing off the excess high pressure exhaust gas into the gas pockets or by enlarging the high pressure exhaust gas channel, the pressure in the high pressure exhaust gas channel still remains too high, i.e. the resulting negative pressure differential of charge air output of the pressure wave machine vs. high pressure exhaust gas supply to the pressure wave machine causes increased expulsion losses of the internal combustion engine and thus deteriorates the fuel efficiency in the partial load range of the internal combustion engine. At the same time, however, an undesired charging pressure subsists downstream of the pressure wave machine due to the insufficient reduction of the exhaust gas pressure in the pressure wave process. Furthermore, in a spark ignition engine with its load control by the throttle, this increased pressure in the intake must be additionally reduced by partially closing the throttle, thereby causing additional losses in the form of regulating losses.

The methods according to CH-A-681 738, EP-A-0 210 328, and WO 99/11914 for blowing off the excess high pressure gas have the disadvantage that the blowoff is insufficient in a wide range of the performance characteristics of the internal combustion engine, however mainly in the partial load range of the latter, i.e. the pressure upstream of the pressure wave machine is at a higher level than the pressure downstream of the pressure wave machine. The result is a negative pressure differential also across the internal combustion engine and thus an increase of the expulsion power required of the pistons of the internal combustion engine. In a spark ignition engine, due to the mixture control, the reduction of the excess pressure in the intake of the engine even requires a partial closure of the throttle, thereby causing additional losses in the form of regulating losses. Both of these loss factors have negative effects on the consumption of the internal combustion engine in partial load.

SUMMARY OF THE INVENTION

On the background of the described prior art, it is the object of the present invention to provide a gas-dynamic pressure wave machine allowing improved consumption characteristics and an increased power over the entire characteristic diagram of an internal combustion engine, more particularly in the partial load range. This is accomplished by the gas-dynamic pressure wave machine, wherein a duct leading from the high pressure exhaust channel to the low pressure exhaust channel is provided which is regulated by suitable means for maintaining the pressure wave process in such a manner that a part of the exhaust flow is always first conducted from the high pressure exhaust channel into the enlargement before additional exhaust is conducted from the high pressure exhaust channel to the low pressure exhaust channel through the duct.

Further advantages and embodiments are defined in the dependent claims.

BRIEF DESCRIPTION OF THE DRAWINGS

The invention is explained in more detail hereinafter with reference to drawings of exemplary embodiments.

FIG. 1 schematically shows a developed cylindrical section through the cells of a rotor of a pressure wave machine of the prior art;

FIG. 2 schematically shows a detail of a developed cylindrical section through the cells of the rotor of FIG. 1;

FIGS. 3, 3A schematically show a detail of a developed cylindrical section through the cells of a rotor of the invention with the slide closed and open, respectively;

FIGS. 4, 4A show a variant of the embodiment of FIGS. 3, 3A;

DETAILED DESCRIPTION OF THE INVENTION

Figure 5:
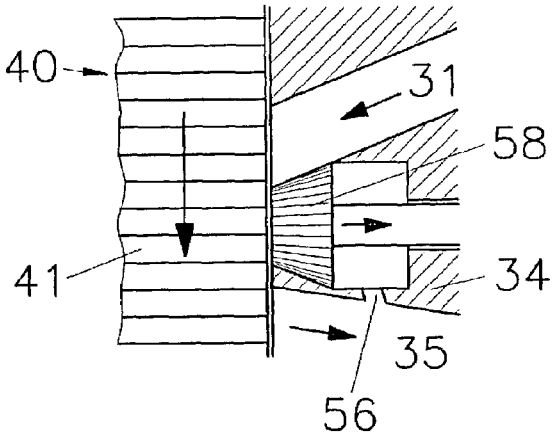
FIGS. 5, 5A show a variant of the embodiment of FIGS. 3, 3A.

For the sake of simplicity, a single pressure wave cycle is represented and described in the developed views. However, the invention is independent from the number of pressure wave cycles, and it may be applied to pressure wave machines having a single cycle or two or more cycles.

FIG. 1 shows a developed view of the rotor of a gas-dynamic pressure wave machine 2 with internal combustion engine 1, high pressure exhaust channel 3 and low pressure exhaust channel 4 including scavenging air S, rotor 6 with individual cells 18, fresh air inlet 8 resp. Law pressure fresh air inlet channel 14, and high pressure charge air channel 10, which ends in charge air channel 11 and leads to internal combustion engine 1.

As already mentioned in the introduction, the process can only be adjusted to a single operating point of the internal combustion engine if the four channels are used without any additional regulating devices. In this context, this is called the design point of the pressure wave machine. The use of pockets in the enclosure wall allows a more tuning-insensitive design of the pressure wave machine and thus an important expansion of its load, speed, and volume range. In the course of the development of such pressure wave machines over the years, different pockets have been milled into enclosure wall 24, e.g. a compression pocket 19, an expansion pocket 20, and a gas pocket 21 including a ridge 21A, whose applications are well known to those skilled in the art. A disadvantage in the application of such pockets is that in the untuned characteristic diagram range, the pressure wave process is diverted to secondary processes that cannot yield optimum efficiency.

Normally, the pressure wave machine is optimally designed for the point specified by the manufacturer of the internal combustion engine, usually at the nominal speed of the motor, by means of known methods such as characteristics methods and design calculations while no pockets are involved or one, two, or all three pockets are used.

Similarly to FIG. 1, FIG. 2 shows a high pressure exhaust gas channel 3 having no means for influencing the high pressure exhaust gas flow. Rotor 6 with its cells 18 is shown in a developed view, and gas enclosure 24, high pressure exhaust gas channel 3, and low pressure exhaust gas channel 4 are further illustrated.

In addition thereto, FIG. 2 shows gas pocket 21 as it is e.g. provided according to CH-A-681 738, which has been mentioned in the introduction. This gas pocket, as well as mainly the necessarily existing ridge 21A between the high pressure exhaust gas channel and the gas pocket, create additional losses, especially in the case of low to medium speeds, temperatures and flow rates, where a blowoff is normally unnecessary.

In FIGS. 4, 4A and 5, 5A of WO 99/11914, which is expressly included by reference, it is schematically shown that the high pressure exhaust channel is influenced by means of a slide.

FIGS. 3 to 6A of the present invention also refer to the influence exerted on the high pressure exhaust gas flow. FIGS. 3 and 3A of the present invention show a developed view of rotor 40 with cells 41, and instead of gas pocket 21 of FIG. 2, a recess 48 serving as a gas pocket is provided in gas enclosure 34 which can be varied by a slide 49 as indicated by arrow 50. In FIG. 3A, slide 49 is entirely engaged in the direction of the arrow, so that the high pressure exhaust gas channel is enlarged without creating a ridge. By a suitable control of the slide, which is calculable for those skilled in the art, the slide may be displaced so as to enlarge the high pressure channel to such an extent that the pressure drops until the charging pressure produced in the pressure wave process decreases to the desired level.

FIGS. 4 and 4A show an alternative embodiment of the slide in the form of a pivoting element 51 that is hinged on an articulation 52 and actuated by a similar electronic control as above, which allows an enlargement 53 of the high pressure channel.

Since the enlargement of the high pressure exhaust gas channel by means of recesses 48 or widened portions 53, as represented in WO 99/11914, is not sufficient to reduce the pressure level of the high pressure exhaust gas to such an extent that the pressure in this high pressure exhaust gas section reaches the desired level near ambient pressure, additional means for a pressure reduction are needed.

These pressure-reducing means comprise the additional passageway 54–57. In FIGS. 3, 3A, it is connecting channel 54 that forms the duct between recess 48 and low pressure exhaust gas channel 35. In FIG. 3, slide 49 is closed, and the recess as well as connecting channel 54 are thus closed. In FIG. 4A, both the recess and connecting channel 54 are open.

When duct 54 is opened, an additional quantity of exhaust gas can now be blown off directly into low pressure exhaust gas channel 35, which is substantially under ambient pressure. The pressure in high pressure exhaust gas channel 31 is thereby reduced to the desired lower level. It is important here that the free additional connecting channel 54 is only opened when a sufficient quantity of exhaust gas has first been blown off through the enlargement of high pressure exhaust gas channel 31 directly into the rotor as the pressure wave process would otherwise be disturbed, thereby disrupting the scavenging of the rotor and conducting undesired exhaust gases to the engine.

In analogy to FIGS. 3, 3A, FIGS. 4, 4A illustrate a connecting channel 55 providing a passage between enlargement 53, which serves as a gas pocket, and low pressure exhaust gas channel 35, enlargement 53 and connecting channel 55 being closed and opened by a pivoting portion 51.

As a variant of the embodiment according to FIGS. 3, 3A, FIGS. 5, 5A schematically illustrate a valve 58 as it is e.g. used in CH-A-681 738 for the control of the gas pocket inflow. Here also, the control ensures that valve 58 is first displaced such that a sufficient amount of high pressure exhaust gas 31 for maintaining the rotor scavenging is diverted into recess 48. Valve 58 is then further opened to open a duct 56. Duct 56 is connected by a suitable connecting channel to low pressure exhaust gas channel 35. Through this duct 56, an additional quantity of exhaust gas can now be blown off directly into low pressure exhaust gas channel 35, which is substantially under ambient pressure. The pressure in high pressure exhaust gas channel 31 is thereby reduced to the desired lower level.

Figure 6:
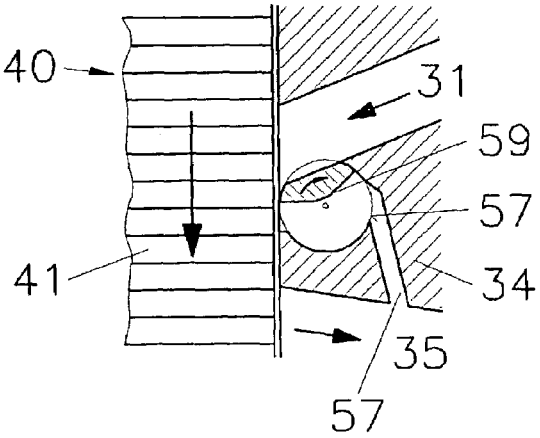
FIGS. 6, 6A show a variant of the embodiment of FIGS. 4, 4A.
Figure 6A:
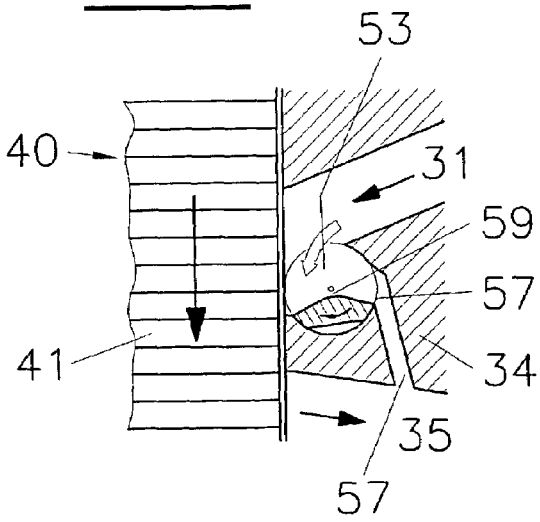

FIGS. 6 and 6A schematically illustrate a barrel 59 as it is used in a similar form in EP-A-0 210 328 for the control of the gas pocket inflow. Here also, barrel 59 is first actuated such that a sufficient amount of high pressure exhaust gas 31 for maintaining the rotor scavenging is diverted into enlargement 53.

Barrel 59 is then further rotated and opens connecting channel 57. Connecting channel 57 is connected to low pressure exhaust gas channel 35. Through this duct, an additional quantity of exhaust gas can now be blown off directly into low pressure exhaust gas channel 35, which is substantially under ambient pressure. The pressure in high pressure exhaust gas channel 31 is thereby reduced to the desired lower level.

It is understood that the same measures may also be applied if other methods for the regulation of the high pressure exhaust gas inflow to the gas pockets are used. In another embodiment of the invention for all kinds of applications, either as previously described or if gas pockets of the prior art are used, the additional exhaust gas flow that is directly conducted from high pressure exhaust gas channel 31 to low pressure exhaust gas channel 35 may be controlled by an additional actuator controlled e.g. by a microprocessor.

Figure 5A:
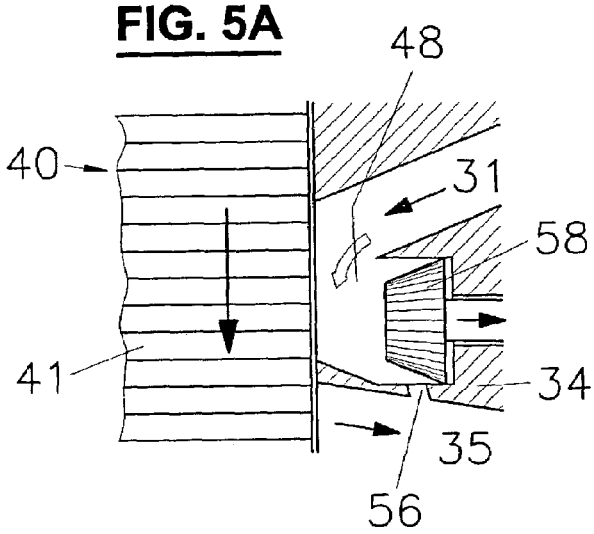

In this context, it is irrelevant whether this additional actuator comprises a flap, a valve, a cylinder or a similar regulating member for an additional blowoff from high pressure exhaust gas channel 31 into low pressure exhaust gas channel 35. However, the applied control technique must ensure that the exhaust gas flow is first guided from the high pressure exhaust gas channel into the gas pocket either through an widened portion of high pressure exhaust gas channel 31, as illustrated in FIGS. 4A and 5A, or through a partial deviation of the exhaust gas flow, before the additional regulating member opens the additional direct passage from high pressure exhaust gas channel 31 to low pressure exhaust gas channel 35. This control procedure is required to maintain the rotor scavenging.

It is an advantage, however not a condition, if the duct from the high pressure exhaust gas channel to the low pressure exhaust gas channel starts at the gas pocket, resp. the recess or the enlargement.

It follows from the preceding description that a method for the reduction of the partial load consumption of piston engines by means of an improvement in efficiency of a gas-dynamic pressure wave machine is provided. The method may be combined with other methods, or it may be used individually through a thermodynamic improvement of a pressure wave machine according to the claims.

Furthermore, it follows that the pressure in the high pressure exhaust gas channel and thus also the charging pressure and the negative pressure differential across the charger are significantly reduced. Since the negative pressure differential across the internal combustion engine is thereby reduced as well, this method also allows to reduce the fuel consumption of the internal combustion engine in partial load. In addition, in spark ignition engines, a regulation by means of a throttle is largely unnecessary in the partial load range as the charging pressure largely corresponds to ambient pressure due to the almost complete reduction of the exhaust gas pressure. The result is a further reduction of the consumption in partial load operation.

Over the entire performance range of an internal combustion engine, the pressure wave machine of the invention allows to keep the negative pressure differential and thus the increased expulsion power required of the internal combustion engine as low as possible, as well as to increase the blowoff to such an extent that the pressure in the high pressure exhaust gas channel can be lowered to a level where also the pressure in the charge air channel may be reduced such that a partial closure of the throttle of the internal combustion engine in the partial load range is unnecessary.

The invention is effective in particular when it is ensured that a sufficient quantity of exhaust gas is first blown off directly into the rotor through the enlargement of high pressure exhaust gas channel 31, resp. through the gas pockets, since the pressure wave process would otherwise be disturbed, thereby disrupting the scavenging of the rotor and conducting undesired exhaust gas to the engine. This can be accomplished by a suitable design of the control technique used in the invention.

We claim:

1. A gas-dynamic pressure wave supercharger for supplying charge air to an internal combustion engine comprising:

a multi-celled rotor;

a low pressure fresh air inlet channel;

a high pressure charge air channel leading to the internal combustion engine;

a high pressure exhaust channel leading from the internal combustion engine to the rotor, and having an enlarged portion on the rotor side thereof;

a low pressure exhaust channel;

a bypass duct extending from the enlarged portion which connects the high and low pressure exhaust channels; and a flow control mechanism which cooperates with the enlarged portion of the high pressure exhaust channel and the bypass duet, wherein:

the high pressure exhaust channel and the low pressure exhaust channel are enclosed in a gas enclosure;

the low pressure fresh air inlet channel and the high pressure charge air channel are enclosed in an air enclosure;

the flow control mechanism is configured and operable to vary the volume of the enlarged portion of the high pressure exhaust channel without forming a ridge, and to vary an aperture of the bypass duct such that a part of the exhaust gas flow is always first conducted from the high pressure exhaust channel into the enlarged portion before additional exhaust is conducted from the high pressure exhaust channel to the low pressure exhaust channel through the bypass duct.

2. A gas-dynamic pressure wave machine supercharger according to claim 1, wherein the flow control mechanism is operable to selcetively regulate flow of exhaust gas from the high pressure exhaust gas channel to the enlarged portion or to the bypass duct.

3. A gas-dynamic pressure wave supercharger according to claim 1, wherein the flow control mechanism is movable to a first position at which a sufficient portion of the exhaust flow is conducted into the enlarged portion to maintain rotor scavenging, and to a second position at which the bypass duct leading to the low pressure exhaust channel is opened.

4. A gas-dynamic pressure wave supercharger according to claim 3, wherein the flow control mechanism comprises a roller rotatable between the first and second positions.

5. A gas-dynamic pressure wave supercharger according to claim 3, wherein the flow control mechanism comprises a valve movable between the first and second positions.

6. A gas-dynamic pressure wave supercharger according to claim 3, wherein the flow control mechanism comprises a member slidable between the first and second positions.

7. A gas-dynamic pressure wave supercharger according to claim 3, wherein the flow control mechanism comprises a member pivotable round an asymmetrically located axis between the first and second positions.

8. A gas-dynamic wave supercharger according to claim 3, further including an actuator operable to move the flow control mechanism between the first and second positions.

9. A gas-dynamic pressure wave supercharger according to claim 8, wherein the actuator is regulated by a microprocessor.

10. A gas-dynamic pressure wave supercharger according to claim 1, wherein the flow control mechanism is regulated by a microprocessor.

* * * * *